US005952274A

United States Patent [19]

Rieckert et al.

[11] Patent Number: 5,952,274

[45] Date of Patent: Sep. 14, 1999

[54] USE OF POLYHYDROXYCARBOXYLAMIDES AS EP ADDITIVES

[75] Inventors: Horst Rieckert, Calw; Karl-Heinz Michel, Taunusstein-Hahn, both of Germany; Jan Zwinselman, Siebnen, Switzerland

[73] Assignee: Schill & Seilacher GmbH & Co., Hamburg, Germany

[21] Appl. No.: 08/918,925

[22] Filed: Aug. 26, 1997

[30] Foreign Application Priority Data

Aug. 27, 1996 [DE] Germany ..... 196 34 605

[51] Int. Cl.[6] ..... C10M 133/16

[52] U.S. Cl. ..... 508/554; 508/555

[58] Field of Search ..... 508/554, 555

[56] References Cited

U.S. PATENT DOCUMENTS

| | | | |
|---|---|---|---|
| 2,622,067 | 12/1952 | White et al. | 508/283 |
| 2,848,418 | 8/1958 | Müller et al. | 508/553 |
| 2,898,301 | 8/1959 | Mayhew et al. | 508/555 |
| 3,527,705 | 9/1970 | Foelsch | 508/551 |
| 3,539,516 | 11/1970 | Walters et al. | 508/555 |
| 4,512,903 | 4/1985 | Schlicht et al. | 252/51.5 |
| 4,557,846 | 12/1985 | Wisotsky | 508/555 |
| 4,647,389 | 3/1987 | Karol et al. | 252/51.5 |

FOREIGN PATENT DOCUMENTS

| | | |
|---|---|---|
| 9206601 | 4/1992 | WIPO . |

*Primary Examiner*—Jacqueline V. Howard
*Attorney, Agent, or Firm*—Hayes, Soloway, Hennessey, Grossman & Hage, P.C.

[57] ABSTRACT

The invention relates to the use of polyhydroxycarboxylamides as an extreme pressure (EP) additive, in particular for lubricants, metalworking fluids and hydraulic fluids. The invention also relates to an extreme pressure (EP) additive containing at least one amide of a polyhydroxycarboxylic acid. Preferred polyhydroxycarboxylamides are the amides of gluconic acid and of glucoheptonic acid.

10 Claims, No Drawings

USE OF POLYHYDROXYCARBOXYLAMIDES AS EP ADDITIVES

The invention relates to the use of polyhydroxycarboxylamides as an extreme pressure additive, in particular for lubricants, metalworking fluids and hydraulic fluids.

The additives known internationally in the field as "extreme pressure additives" are added to fluids such as gear oils, engine oils, metalworking oils and hydraulic fluids in order to impart a high load-carrying capacity such as that required in the transmission of large forces to prevent mutually touching metal surfaces from fusing together and being subject to uncontrolled wear and tear.

U.S. Pat. No. 4,647,389 discloses lubricant additives which are produced by reacting a natural oil, eg coconut oil or palm oil, with a (2–10 C) hydroxy acid and a polyamine. The additives concerned are hydroxyacylated fatty acid amides of polyamines, which act as friction modifiers in lubricating oil compositions but not as EP additives.

U.S. Pat. No. 4,512,903 discloses hydroxyacylated amides of primary and secondary fatty acid amines as lubricant additives which likewise act as friction modifiers but not as EP additives.

The extreme pressure additives conventionally used are sulphur compounds, which form a sulphide film under extreme pressure conditions, chlorine compounds, phosphorus compounds, organic nitrogen compounds and metal soaps such as zinc stearate (see *Ullmanns Encyklopädie der technischem Chemie,* $4^{th}$ edition, 1981, Volume 20, pp. 552 et seq.).

Although all these classes of compounds act as perfectly effective extreme pressure additives, they have a very wide variety of "side-effects" which are undesirable in the respective intended application. For example, sulphur and chlorine compounds subject most metal materials to chemical attack and, at the same time, pollute waste water and therefore the environment. Metal soaps such as zinc stearate also cause waste water to be polluted with heavy metals, thus necessitating elaborate waste water purification processes. Finally, phosphates promote the growth of bacteria, which is extremely dangerous especially in the case of hydraulic fluids, since the bacterial growth modifies the rheological properties of the oils and/or emulsions, possibly causing the systems to break down.

For all these reasons there is still a considerable need to provide the person skilled in the art with further agents which can be used as an extreme pressure (EP) additive; these agents and compounds need to be non-toxic, non-polluting to waste water and therefore environmentally compatible, in particular releasing no heavy metals and/or heavy metal ions, no poisonous gases such as hydrogen sulphide and no strong acids such as hydrogen chloride and/or hydrochloric acid or sulphur dioxide and/or sulphuric acid, yet at the same time possessing outstanding lubricating properties and friction and wear values.

It has now surprisingly been found that polyhydroxycarboxylamides, which have hitherto ben used as sugar substitutes and dietary foods, can be used as an extreme pressure (EP) additive, in particular for lubricants, metalworking fluids and hydraulic fluids. These polyhydroxycarboxylamides are known, eg from international patent application PCT/US91/07534, published as WO92/06601.

The amides of polyhydroxycarboxylic acids which can be used as an EP additive according to the invention, in particular the amides of sugar acids with 5 to 7 C atoms, most particularly of gluconic acid and glucoheptonic acid, may be N-unsubstituted amides; preferably, however, they are N-substituted amides, in particular alkylamides and dialkylamides with alkyl radicals having 1 to 4 C atoms, and also monohydroxyalkylamides and polyhydroxyalkylamides, aminoalkylamides and aminohydroxyalkylamides, the respective alkyl radical having 1 to 4 C atoms in all cases.

Polyhydroxycarboxylamides which are particularly preferred according to the invention are:

N,N-dimethylgluconamide, N-[2-(hydroxyethyl)]gluconamide, N-[2-(aminoethyl)]gluconamide, N-[2-(hydroxypropyl)]gluconamides; N-[1,2-dihydroxyproypyl]gluconamide, N,N-dimethylglucoheptonamide, N-[2-(hydroxyethyl)]glucohaptonamide, N-[2-(aminoethyl)]glucoheptonamide, N-[2-(hydroxypropyl)]glucoheptonamide and N-[1,2-dihydroxypropyl]glucoheptonamide.

Preferably at least one of the polyhydroxycarboxylamides is contained in an oleaginous or aqueous composition, eg in a lubricant, an engine or a gear oil, a metalworking oil or metalworking fluid or an hydraulic fluid, these fluids also possibly being present in the form of an emulsion, eg a water-in-oil emulsion or an oil-in-water emulsion.

An oleaginous or aqueous composition of this kind also preferably contains at least one corrosion inhibitor, borate esters being particularly preferred as corrosion inhibitors. The composition may also contain at least one emulsifier.

The simultaneous use of one of the above polyhydroxycarboxylamides and at least one polyalkylene glycol has proved to be particularly advantageous: the Reichert friction and wear values measured using a combined additive of this kind unequivocally indicate a synergistic effect which begins when one of the above amides and one polyalkylene glycol are used simultaneously. At present there is no scientific explanation for this effect.

The at least one polyhydroxycarboxylamide is preferably used in a quantity such that the amide constituent comprises up to 70 wt. % of the respective composition. The composition is, however, preferably diluted with water before use, the amide constituent comprising 0.01 to 3.0 wt. % of the respective composition.

The polyhydroxycarboxylamides used are chiral compounds which have at least one asymmetric carbon atom and can therefore be present in the form of enantiomers and in the form of racemates. The particularly preferred gluconamides and glucoheptonamides may therefore be present in the D or L form or as D,L racemate.

The subject-matter of the invention also comprises an extreme pressure (EP) additive, in particular for lubricants, metalworking fluids and hydraulic fluids, said additive containing at least one amide of a polyhydroxycarboxylic acid but preferably also additionally containing at least one corrosion inhibitor and/or at least one emulsifier.

The emulsifier can be any conventional emulsifier known for this purpose and the corrosion inhibitor can be any conventional corrosion inhibitor known for this purpose, provided that these additional agents are chemically compatible with the polyhydroxycarboxylamides. This can be determined quickly by simple preliminary tests with which the skilled person is familiar.

Most preferably, the additive according to the invention also additionally contains at least one polyalkylene glycol, eg diethylene glycol, polyethylene oxide and/or polypropylene oxide or the like.

The constituent comprising the at least one amide preferably comprises 0.01 to 70 wt. % of the extreme pressure additive.

The additive according to the invention preferably contains one of the above gluconamides or glucoheptonamides.

The polyhydroxycarboxylamides used in accordance with the invention can be produced as described in document WO 92/06601. N-2-(hydroxyethyl)]-D-gluconamide [sic] can, for example, be produced by adding methanol to one mol of D(+)-gluconolactone, which is insoluble in methanol, and by heating to 65° C. under stirring. 1 mol of ethanolamine dissolved in methanol is slowly added to the lactone suspension. A spontaneous exothermic reaction takes place, during which the gluconolactone dissolves completely. To complete amide formation, the mixture is refluxed for a further two hours. The solution is then slowly cooled under continuous stirring, during which process the solid amide precipitates out of the solution. The solution is then filtered and the residue washed twice with methanol. The yield is 95% pure N-[2-(hydroxyethyl)]-D-gluconamide, hereinafter abbreviated to "HEGA".

The EP additive properties of HEGA were determined and tested using the Reichert friction and wear test. For this purpose the additive was added in amounts of 5, 10 and 20 wt. % to the commercially available metalworking fluids Cool 1, Cool 10 and Cool Syn 100.

Cool 1 is an emulsion based on mineral oil and containing 15% mineral oil, corrosion inhibitors (borate esters) and emulsifiers.

Cool 10 is an ester-based cutting oil containing 10% esters emulsified in water, plus corrosion inhibitors and emulsifiers.

Cool Syn 100 is an aqueous system based on polyalkylene glycol and with corrosion inhibitors but no emulsifiers.

The Reichert friction and wear test is carried out as follows: a metal roller or roll is pressed firmly against a rotating slip ring, the lower third of which is immersed in the fluid under test. The speed of rotation of the slip ring is adjusted so that the fluid undergoing the load-carrying capacity test enters and wets the point of contact and hence the point of frictional wear between the roller and the slip ring. When the slip ring rotates, there are produced on the roller elliptical abrasion areas, th size of which is dependent on the load-carrying capacity of the fluid under test. The smaller the area of abrasion after a precise time or after a precise length of travel, the greater the load-carrying capacity. The Reichert friction and wear test measures not only the area of abrasion, which is measured after a circumferential path of 100 m, but also the "noise meters" characteristic. When the slip ring is set in motion, initially a grinding, metallic noise is heard until the fluid under test has formed a reaction film between the slip ring and the roller. The circumferential path which the slip ring has covered before this noise suddenly stops is measured in "noise meters". The lower the number of noise meters, the more suitable as an EP additive the fluid will be. When pure water is used, no reaction film forms, so the noise is audible over the entire test path of 100 m.

Tables 1 and 2 below give seven examples of metalworking fluids to which the HEGA amide has been added in varying quantities as an EP additive. Example 1 comprises 95 wt. % Cool 1 and 5 wt. % HEGA, Example 2 comprises 90 wt. % Cool 1 and 10 wt. % HEGA, Example 3 comprises 95 wt. % Cool 10 and 5 wt. % HEGA. Example 4 comprises 90 wt. % Cool 10 and 10 wt. % HEGA, Example 5 comprises 95 wt. % Cool Syn 100 and 5 wt. % HEGA, Example 6 comprises 90 wt. % Cool Syn 100 and 10 wt. % HEGA, and Example 7 comprises 80 wt. % Cool Syn 100 and 20 wt. % HEGA The following technical data are given for each of these seven examples in Table 2:

1. The solubility of the HEGA amide in the metalworking fluids Cool 1, Cool 10 and Cool Syn 100 respectively. Solubility in all seven cases is good (g).
2. The change in the fluid as a result of the amide additive. No change was observed in any of the seven examples.
3. Solubility in the fluids used. The water-soluble HEGA dissolved completely in all the systems.
4. The stability of the emulsion. In all seven examples it met requirements (indicated by "OK").
5. The pH when diluted with water (1:10).
6. The pH when diluted with water (1:20).
7. The anti-corrosive action in a 2% dilution.
8. The anti-corrosive action in a 3% dilution.
9. The Reichert friction and wear value (RFW) in a 2% dilution; abrasion area in $mm^2$.
10. The Reichert friction and wear value (RFW) in a 3% dilution; abrasion area in $mm^2$.

In particular, a comparison of the RFW values for Examples 1 to 4 on the one hand and Examples 5 to 7 on the other shows that the simultaneous presence of the HEGA polyhydroxycarboxylamide and a polyalkylene glycol causes a significant reduction in the RFW values by at least 50%.

Further Reichert friction and wear tests were carried out on the EP additive according to the invention, namely N-[2-(hydroxyethyl)]-D-gluconamide (HEGA), in varying concentrations and compositions. The results are given in Table 3 below. The noise meters, abrasion area and bath temperature were measured for each of the various fluids. Pure water and a 5% aqueous solution of a standard additive, namely boric amide, was used for comparison with the EP additive according to the invention. The HEGA according to the invention was likewise used in aqueous solution in concentrations of 5, 10, 20 and 30%, without further additives. One test was carried out with a composition comprising 2.5% HEGA, 82.5% water and 15% known corrosion inhibitors and emulsifiers. As Table 3 shows, even at a very low concentration of 5% HEGA, both the noise meters and the abrasion area are reduced to 14 m and 12 $mm^2$ respectively. An increase in the concentration from 5 to 10% HEGA results in a further reduction in the noise meters to 10 m, while the abrasion area remains the same at 12 $mm^2$. A further increase in the HEGA concentration to 20 or 30% produces only a very slight further improvement in the noise meters and the abrasion area. This means that the effect achieved with the use, according to the invention, of polyhydroxycarboxylamides commences even at very low concentrations, and that an increase in the concentration does not make economic sense in most cases, since the best compromise between cost and benefit is achieved even at minimal concentrations. This is of major significance for the industrial use of the EP additives according to the invention.

The best results, namely the lowest number of noise meters (7 m) and the smallest abrasion area (9 $mm^2$), are achieved with a combination of minimal quantities of HEGA (2.5%) and known corrosion inhibitors such as borate esters or polyalkylene glycols. This synergistic effect, which is completely surprising to experts in the field, makes the use of polyhydroxycarboxylamides as EP additives particularly attractive in both technical and economic terms.

The use, according to the invention, of polyhydroxycarboxylamides as EP additives therefore offers the following advantages: the additives used are readily biodegradable; they are water-soluble, which means that as a rule neither emulsifiers nor antifoam agents are need; they are inherently non-foaming; they are particularly suitable for use in the machining of iron and ferrous metals; and they are non-toxic, as demonstrated in particular by their known use as sugar substitutes and dietary foods. The amides used according to the invention can be used in both anhydrous and aqueous metalworking fluids, in hydraulic fluids, in textile machining fluids and in fluids for cutting and grinding metals and glass.

TABLE 1

| Example No. | 1 | 2 | 3 | 4 | 5 | 6 | 7 | |
|---|---|---|---|---|---|---|---|---|
| Cool 1 | 95.0 | 90.0 | | | | | | |
| HEGA | 5.0 | 10.0 | | | | | | |
| Cool 10 | | | 95.0 | 90.0 | | | | |
| HEGA | | | 5.0 | 10.0 | | | | |
| Cool Syn 100 | | | | | 95.0 | 90.0 | 80.0 | % |
| HEGA | | | | | 5.0 | 10.0 | 20.0 | % |
| | 100 | 100 | 100 | 100 | 100 | 100 | 100 | % |

TABLE 2

| Example No. | 1 | 2 | 3 | 4 | 5 | 6 | 7 |
|---|---|---|---|---|---|---|---|
| Solubility in concentrate | g | g | g | g | g | g | g |
| Change in concentrate | 0 | 0 | 0 | 0 | 0 | 0 | 0 |
| Solubility | OK | OK | OK | OK | OK | OK | OK |
| Stability of the emulsion | OK | OK | OK | OK | OK | OK | OK |
| pH value 1:10 | 9.4 | 9.4 | 9.5 | 9.5 | 9.5 | 9.5 | 9.5 |
| pH value 1:20 | 9.3 | 9.3 | 9.4 | 9.4 | 9.4 | 9.3 | 9.2 |
| Corrosion protection 2% | OK | OK | OK | OK | OK | OK | OK |
| Corrosion protection 3% | OK | OK | OK | OK | OK | OK | OK |
| RFW 2% [$mm^2$] | 22.4 | 18.3 | 22.8 | 17.8 | 12.2 | 9.8 | 7.6 |
| RFW 3% [$mm^2$] | 20.6 | 17.1 | 20.4 | 19.7 | 10.0 | 7.9 | 7.0 |

TABLE 3

| Medium | Noise meters [m] | Abrasion area [$mm^2$] | Bath temperature [° C.] |
|---|---|---|---|
| Water | 100 | 38 | 70 |
| 5% HEGA 95% water | 14 | 12 | 40 |
| 10% HEGA | 10 | 12 | 34 |
| 20% HEGA | 9 | 10 | 34 |
| 30% HEGA | 8 | 10 | 33 |
| 2.5% HEGA 15% additives | 7 | 9 | 35 |
| 5% standard amide (comparison) | 14 | 28 | 50 |

We claim:

1. In a method of imparting to a fluid selected from the group consisting of a lubricant or a metalworking fluid or an hydraulic fluid a high load-carrying capacity by adding to said fluid an extreme pressure (EP) additive, the improvement which comprises using at least one polyhydroxycarboxylamide comprising an amide of a sugar acid having 5 to 7 carbon atoms as said EP-additive.

2. The method of claim 1, the improvement wherein the polyhydroxycarboxylamide used comprises an amide of gluconic acid or an amide of glucoheptonic acid.

3. The method of claim 1, the improvement wherein the at least one polyhydroxycarboxylamide is used in the form of an oleaginous composition or an aqueous composition.

4. The method of claim 3, the improvement wherein said composition also includes at least one corrosion inhibitor.

5. The method of claim 4, the improvement wherein said at least one corrosion inhibitor comprises a borate ester.

6. In a method of imparting to a fluid selected from the group consisting of a lubricant or a metalworking fluid or an hydraulic fluid a high load-carrying capacity by adding to said fluid an extreme pressure (EP) additive, the improvement which comprises using at least one polyhydroxycarboxylamide in the form of an aqueous composition containing at least one emulsifier as said EP-additive.

7. The method of claim 3, the improvement wherein said composition comprises at least one polyalkylene glycol.

8. The method of claim 3, the improvement wherein said composition comprises said at least one polyhydroxycarboxylamide in an amount of from 0.01 to 70% by weight of said composition.

9. In a method of imparting to a fluid selected from the group consisting of a lubricant or a metalworking fluid or an hydraulic fluid a high load-carrying capacity by adding to said fluid an extreme pressure (EP) additive, the improvement which comprises using at least one polyhydroxycarboxylamide as said EP-additive, and including the step of diluting said polyhydroxycarboxylamide, before use, with water so as to produce an aqueous composition comprising said at least one polyhydroxycarboxylamide in an amount of from 0.01 to 3.0% by weight of said composition.

10. An extreme pressure (EP) additive for use with lubricants, metalworking fluids and hydraulic fluids, said additive comprising from 0.01 to 70% by weight of at least one amide of a polyhydroxycarboxylic acid selected from the group consisting of:

N,N-dimethyl gluconamide,

N-[2-(hydroxyethyl)]gluconamide,

N-[2-(aminoethyl)]gluconamide,

N-[2-(hydroxypropyl)]gluconamide,

N-[1,2-dihydroxypropyl]gluconamide,

N,N-dimethyl glucoheptonamide,

N-[2-(hydroxyethyl)]glucoheptonamide,

N-[2-(aminoethyl)]glucoheptonamide,

N-[2-(hydroxypropyl)]glucopheptonamide, and

N-[1,2-dihydroxypropyl]glucoheptonamide, said additive additionally comprising at least one of the group consisting of a corrosion inhibitor, an emulsifier, and polyalkylene glycol.

* * * * *

UNITED STATES PATENT AND TRADEMARK OFFICE

CERTIFICATE OF CORRECTION

PATENT NO. : 5,952,274

DATED : September 14, 1999

INVENTOR(S) : Rieckert et al

It is certified that error appears in the above-identified patent and that said Letters Patent is hereby corrected as shown below:

Title Page, Item [75], "TAKUNUSSTEIN-HAHN" SHOULD BE - EPPELS-HEIM--

Signed and Sealed this

Second Day of May, 2000

*Attest:*

Q. TODD DICKINSON

*Attesting Officer*

*Director of Patents and Trademarks*